US005088693A

United States Patent [19]

Brenot

[11] Patent Number: 5,088,693

[45] Date of Patent: Feb. 18, 1992

[54] SELF-TAILING WINCH WITH PIVOTING TEETH

[76] Inventor: Claude Brenot, 36, Chemin de la Cybellerie, 86280 Saint-Benoit, France

[21] Appl. No.: 501,808

[22] Filed: Mar. 28, 1990

[30] Foreign Application Priority Data

Apr. 5, 1989 [FR] France ..... 89 04487

[51] Int. Cl.[5] ..... B66D 1/22; B66D 1/30

[52] U.S. Cl. ..... 254/344; 254/371

[58] Field of Search ..... 242/117; 254/278, 342, 254/344, 371, 372, 374

[56] References Cited

U.S. PATENT DOCUMENTS

| | | | |
|---|---|---|---|
| 2,726,062 | 11/1953 | Sherwood | 254/371 |
| 2,853,273 | 9/1958 | Berge | 254/371 |
| 3,120,043 | 2/1964 | Henley | 254/371 |
| 3,985,340 | 10/1976 | Guangorena | 254/371 |
| 4,230,306 | 10/1980 | Porter | 254/371 |
| 4,475,718 | 10/1984 | van Beers | 254/371 |
| 4,595,173 | 6/1986 | Anderson | 254/371 |

FOREIGN PATENT DOCUMENTS

| | | |
|---|---|---|
| 0066936 | 12/1982 | European Pat. Off. . |
| 937085 | 12/1955 | Fed. Rep. of Germany . |
| 2653317 | 6/1978 | Fed. Rep. of Germany . |
| 383514 | 3/1908 | France . |
| 2307760 | 11/1976 | France . |
| 2594089 | 8/1987 | France . |
| 1588010 | 4/1981 | United Kingdom . |
| 2058000 | 4/1981 | United Kingdom . |

*Primary Examiner*—Daniel P. Stodola
*Assistant Examiner*—William G. Battista, Jr.
*Attorney, Agent, or Firm*—Hoffman, Wasson and Gitler

[57] ABSTRACT

A self-tailing winch with pivoting teeth comprising a fixed support constituting a base, a drum mounted to rotate about the fixed support, a vertical shaft for driving the drum in rotation and connected thereto via a transmission including a stepdown gear train, and an automatic clamping mechanism for clamping cable or rope wound around the winch, which clamping mechanism is mounted at the top of the drum in order to form a self-tailing head for the rope. The automatic cable or rope clamping mechanism comprises a plurality of pivoting teeth distributed around the bottom portion of a block on top of the drum and constrained to rotate therewith, and springs mounted in the block in order to exert downwards pressure individually on each of the pivoting teeth which themselves exert pressure individually on the rope in order to pinch the rope against the top end of the drum, thereby enabling the same winch to operate effectively with ropes of different types and of different sections.

10 Claims, 6 Drawing Sheets

SELF-TAILING WINCH WITH PIVOTING TEETH

The present invention relates to a self-tailing winch with pivoting teeth comprising a fixed support constituting a base, a drum mounted to rotate about the fixed support, a vertical shaft for driving the drum in rotation and connected thereto via a transmission including a stepdown gear train, and automatic clamping means for clamping cable or rope wound around the winch, which clamping means are mounted at the top of the drum in order to form a self-tailing head for the rope.

BACKGROUND OF THE INVENTION

Self-tailing winches are already known and they are used in particular on sailboats where they serve to keep a cable or rope under tension while it is being wound on the drum of the winch. A user can operate such a winch with one hand only.

Self-tailing winches often include a notched V-groove pulley disposed at the top of the drum. However, a winch of this type is suitable only for a given diameter of cable or a given kind of fiber. As a result, it is necessary, particularly on a sailboat, to have a large number of winches of different sizes suitable for the different ropes used on a boat (haliards, sheets, . . . ).

In addition, prior art winches are often difficult to operate because they provide an inadequate stepdown ratio in the winch drive mechanism. In other cases, manufacturing and maintenance costs are too high because the mechanism is complex.

In addition, winches on boats often provide limited operating safety, in particular because the rotation of the rotating head is liable to cause accidents.

The present invention seeks to remedy the above-mentioned drawbacks, and in particular to enable a large number of different cables or ropes to pass over the same type of winch so as to reduce the number of winches required, particularly on board a boat.

An object of the invention is thus to provide a winch provided with an automatic head ensuring self-tailing of a rope and enabling it to be used without special adjustment over a wide variety of types of rope with rope diameters varying in a ratio of 1 to 2, or with ropes including fibers of different kinds imparting different stiffnesses to the rope.

Another object of the invention is to provide a winch in which manufacture and utilization are improved by virtue of a mechanism providing a large stepdown ratio in a small volume, said mechanism being capable of being made in standardized modular form applicable to winches of different sizes, thereby further reducing manufacturing costs.

Another object of the invention is to improve operation and safety in the use of winches.

SUMMARY OF THE INVENTION

These objects are achieved by a self-tailing winch of the type defined at the beginning of the description, wherein the automatic cable or rope clamping means comprise a plurality of pivoting teeth distributed around the bottom portion of a block on top of the drum and constrained to rotate therewith, and springs mounted in said block in order to exert downwards pressure individually on each of the pivoting teeth which themselves exert pressure individually on the rope in order to pinch the rope against the top end of the drum.

The bottom portion of the support block for the clamping means has a cylindrical portion whose diameter is substantially equal to the diameter of the drive zone of the drum, and the pivoting teeth are guided laterally in slots provided in the block.

The number of pivoting teeth may lie in the range 4 to 8.

Advantageously, the ends of the pivoting teeth are caused to taper by respective sloping chamfers defining pressure-applying edges.

The pivoting teeth are disposed in the block in such a manner as to define a polygon, and they have pressure-applying edges disposed tangentially to a circle whose diameter is slightly smaller than the diameter of the winding zone of the drum.

The pivoting teeth are pivoted at their bottom rear ends about horizontal pins imprisoned in a groove formed in the top portion of the drum.

In a particular aspect of the present invention, the winch includes a fixed casing mounted on the fixed support and surrounding the head of the winch in such a manner as to protect the rotary portions thereof, and a guide for passing rope from the drum to the self-tailing head is fixed on said fixed casing.

The winch includes an ejector mounted on the casing or on the support axis of the guide, and disposed above the end of the drum in such a manner as to prevent rope from continuing to rotate in the self-tailing head after it has rotated through a predetermined angle of rotation.

The ejector is mounted at a level situated immediately beneath the pivoting teeth for pinching the rope.

Advantageously, the ejector is mounted beneath the pivoting teeth at such a level as to constitute a cam which slightly raises each tooth as it passes over the ejector, thereby positively releasing the rope-pinching effect of the tooth.

Preferably, in the winch of the invention, the stepdown gear train transmission includes an epicyclic stepdown gear comprising a central gear fixed to the drive shaft, a bell-shaped gear comprising a toothed ring and an outlet gear, a set of planet gears co-operating with the ring and rotating about pins which are fixed to a planet carrier which is prevented from rotating in the reverse direction by a set of pawls, a toothed ring formed at the bottom of the drum, at least two diametrically opposite gear wheels on opposite sides of the shaft and co-operating with the outlet gear and with the toothed ring, and a set of pawls constraining the bell-shaped gear to rotate together with the shaft when the shaft is rotated in the opposite direction to the direction of drum rotation.

The transmission assembly, apart from the diametrically opposite gear wheels and the toothed ring fixed to the drum constitute a modular assembly which is independent of the size of the winch mounted on the drive shaft, said modular assembly being inserted into the support from the bottom, which bottom is closed by a removable plate.

BRIEF DESCRIPTION OF THE DRAWINGS

An embodiment of the invention is described by way of example with reference to the accompanying drawings, in which.

DETAILED DESCRIPTION

Figure 1:
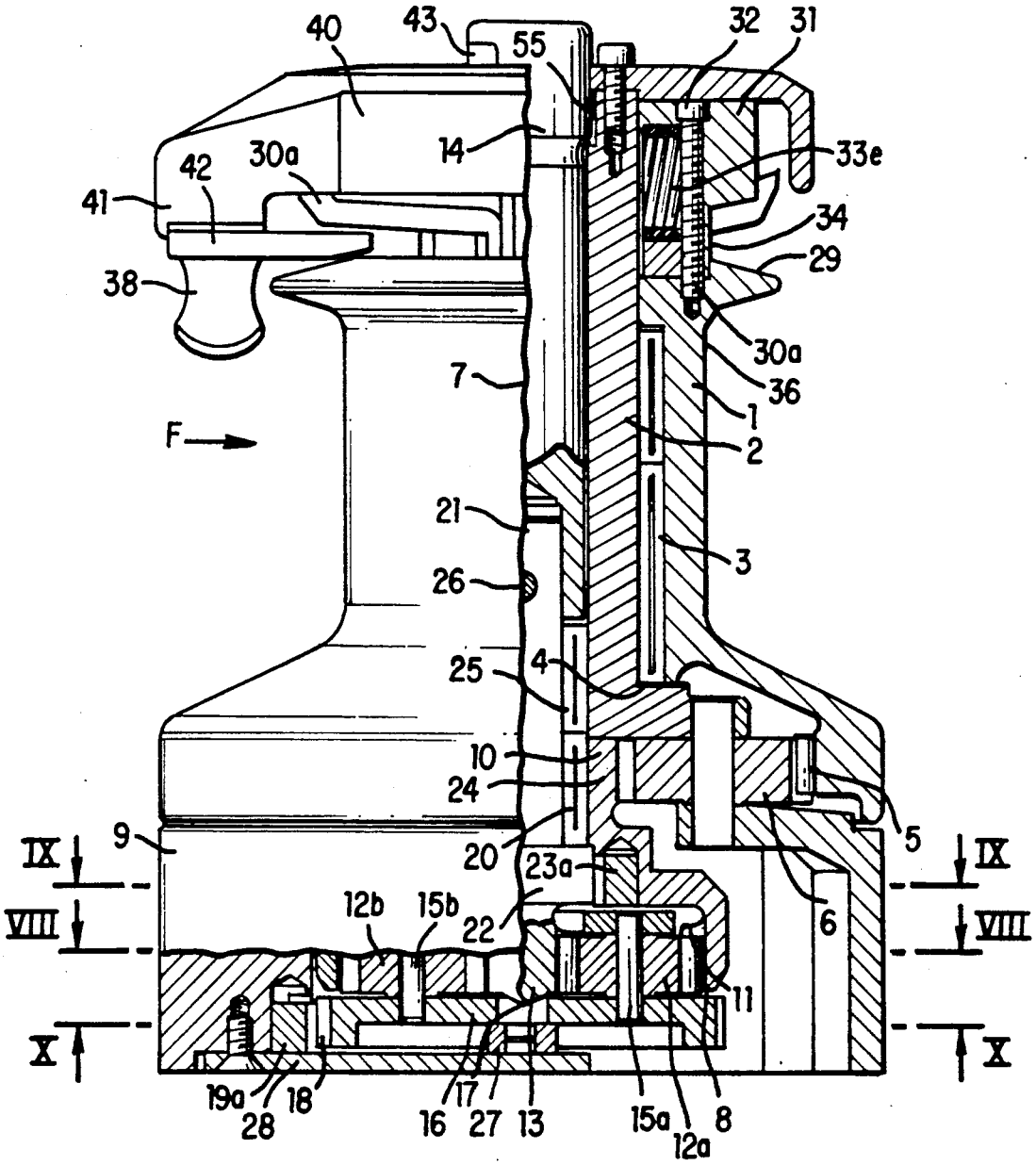
FIG. 1 is a general elevation view of a self-tailing winch of the invention with the assembly being shown in axial half section and with the bottom portion being shown in fragmentary section in order to show a portion of the mechanism.

FIG. 1 is an overall view of a winch of the invention shown partially in section.

The winch comprises a drum 1 rotatably mounted about a base 2 via a roller bearing 3 which may be in one or two stages. A thrust washer 4 of plastic material (which could be replaced by a needle abutment or a ball abutment of conventional type) enables the drum 1 to stand on the base 2 with a minimum of friction.

The drum 1 is rotated by means of a toothed ring 5, itself actuated by means of two spacer gear wheels 6 disposed symmetrically on either side of the axis of symmetry 7 of the winch. The two gear wheels 6 rotate about pins 8 fixed at one end in the base 2 and at the other end in a base casing 9 constituting a portion of the base 2.

Figure 8:
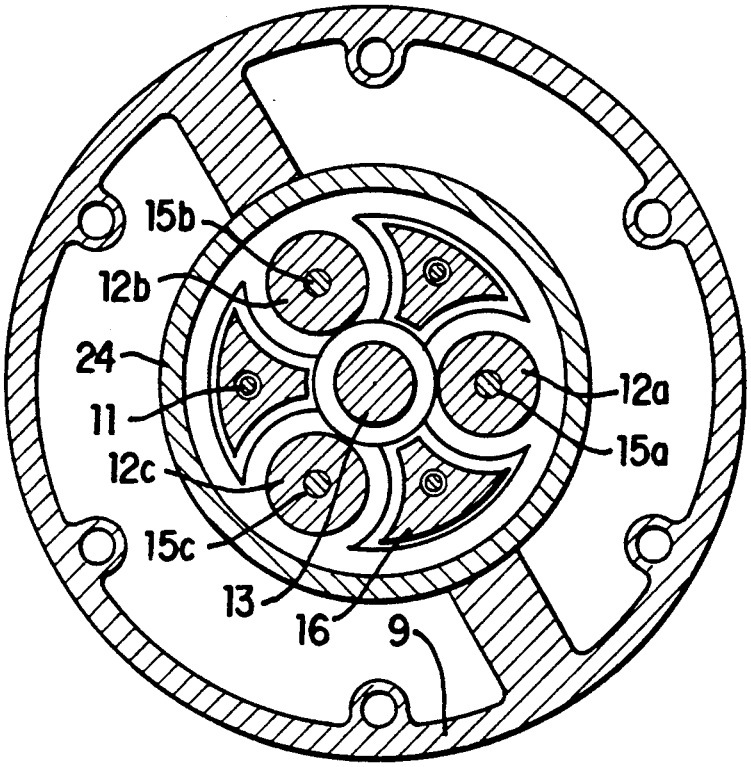
FIG. 8 is a section on line VIII—VIII of FIG. 1, showing a portion of the modular transmission assembly.

The gear wheels 6 are driven by the output gear 10 of a stepdown gear mechanism. The gear 10 is itself fixed to a toothed ring 11 of a bell-shaped gear 24. The bell-shaped gear 24 is driven by three planet gears 12*a* to 12*c* regularly distributed around the axis 7 (FIG. 8). The planet gears 12*a* to 12*c* mesh with a central sun gear 13 fixed to a vertical drive shaft 14 driven by a handle or possibly by an electric motor or a hydraulic motor.

The three planet gears 12*a* to 12*c* rotate about three pins 15*a* to 15*c* which are themselves fixed to a planet carrier 16.

Figure 10:
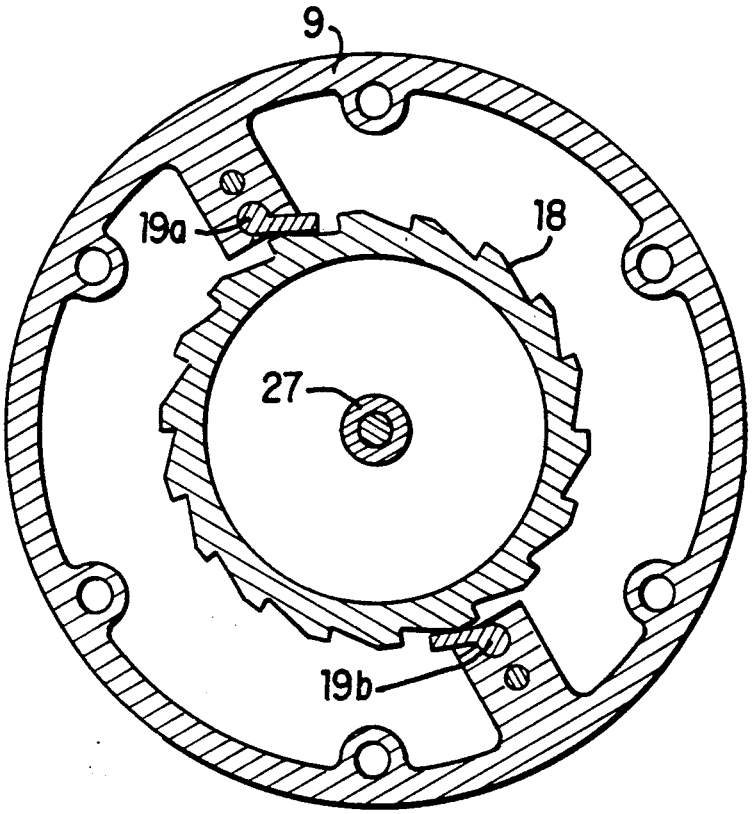
FIG. 10 is a section on line X—X of FIG. 1.

The planet carrier 16 rotates on the bottom end 17 of the shaft 21 of the stepdown gear mechanism. At its periphery it includes teeth 18 engaging conventional spring pawls 19*a* and 19*b* which are fitted to the fixed casing 9 (FIG. 10).

These pawls 19*a* and 19*b* oppose rotation of the planet carrier 16 in the clockwise direction (when looking down on the winch).

The epicyclic stepdown gear assembly constituted in this way rotates concentrically about the shaft 21 which is guided in rotation on roller bearing 20 or on some other type of conventional bearing.

Figure 9:
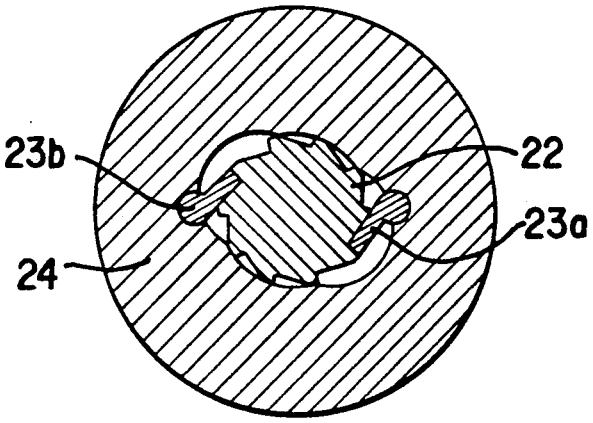
FIG. 9 is a section on line IX—IX of FIG. 1, with the base of the winch removed.

The shaft 21 has a toothed ring 22 engaging sprung pawls 23*a* and 23*b* fitted to the body of the bell-shaped gear 24 (FIG. 9).

These pawls 23*a* and 23*b* cause the shaft 21 and the bell-shaped gear 24 to rotate together when the shaft 21 is driven anticlockwise. The shaft 21 and the drive shaft 14 are fixed together by a pin 26. A roller bearing 25 or other conventional type of bearing serves to guide the rotation of the shaft 21 in the base 2.

The epicyclic stepdown gear train constituted in this way makes it possible, by virtue of the pawls 19*a*, 19*b*, and 23*a*, 23*b* to obtain two different stepdown ratios depending on whether the shaft 14 is driven in one direction or the other:

a) When the drive shaft 14 is driven anticlockwise, the output gear 10 of the stepdown gear mechanism is driven directly by the action of the pawls 23*a* and 23*b* and the freedom allowed to the planet carrier 16 to rotate in this direction. The stepdown gear ratio obtained in this way is equal to the quotient of the number of teeth on the ring 5 divided by the number of teeth on the gear 10.

b) When the drive shaft 14 is driven in the clockwise direction, the pawls 23*a* and 23*b* are disengaged, the sun gear 13 drives the ring 11 of the bell-shaped gear 24 in the opposite direction via the planet gears 12*a* to 12*c*. In this case, the pawls 19*a* and 19*b* prevent the planet carrier 16 from rotating.

The epicyclic gear train thus operates fully by adding its additional stepdown gear ratio and by reversing the direction of rotation, thereby making it possible to obtain a different and greater stepdown ratio at the drum, with the drum continuing to rotate in the proper direction (clockwise). The drum is prevented from rotating in the opposite direction by the sets of pawls 23*a*, 23*b*, and 19*a*, 19*b*.

The epicyclic stepdown assembly is held in position vertically by means of a step bearing 27 itself held in place by a closure plate 28. The plate 28 also serves to hold the pawls 19*a* and 19*b* (FIG. 10) in their housings in the base casing 9.

The automatic self-tailing head is constituted by a block 31 which may be made of plastic and in which a variable number of drive teeth (30*a* to 30*e*) depending on the size of the winch, e.g. 4 to 8 (FIG. 3), are pivoted, which teeth may be made as aluminum or steel castings, for example.

The block 31 is fixed on the top portion 29 of the drum 1 by screws 32 or by any other conventional assembly means. The bottom portion of this block has a cylindrical portion 34 whose diameter is equal or very close to that of the drive zone 36 of the drum (FIG. 1).

Figure 3:
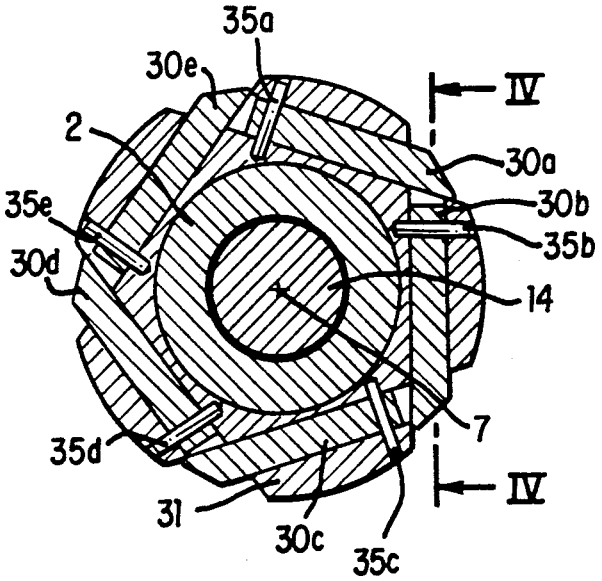
FIG. 3 is a section on line III—III of FIG. 2, showing the pivoting teeth of the self-tailing head of the winch of the invention.
Figure 4:
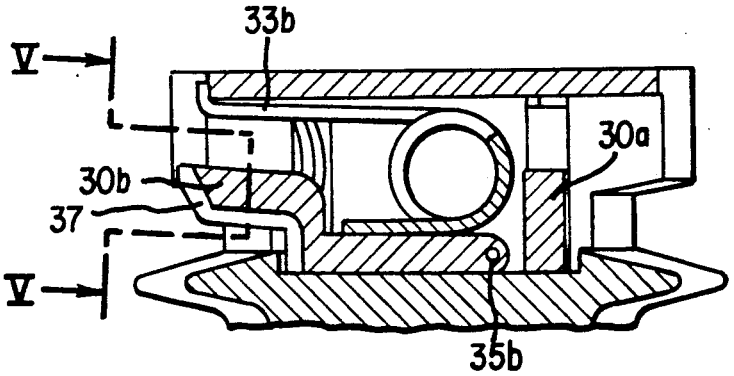
FIG. 4 is a local section through the self-tailing head on line IV—IV of FIG. 3, with the protective cover of the head removed.
Figure 5:
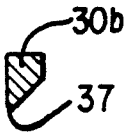
FIG. 5 is a section on line V—V of FIG. 4 showing the chamfered shape of the end of a pivoting tooth.

The drive teeth 30*a* to 30*e*, more particularly visible in FIGS. 3 to 5, are pivoted at their trailing bottom ends about pins 35*a* to 35*e*, and they are guided laterally in slots in the block 31.

The ends 37 of the teeth are tapered by means of respective sloping chamfers cut in each tooth in such a manner as to exert highly localized pressure on the rope and to facilitate insertion of the rope into the self-tailing head (FIG. 5).

Figure 6:
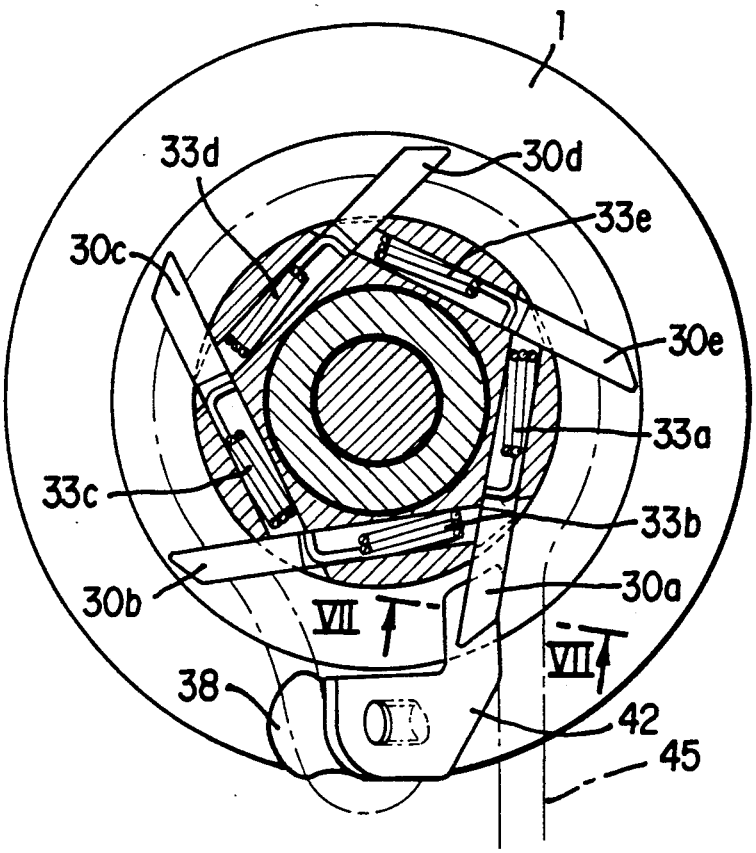
FIG. 6 is a section view of the FIG. 2 winch without its cover and taken on line VI—VI of FIG. 2, with the ejector being in place.

Each tooth exerts pressure on the rope which is imprisoned between the end 37 of the tooth and the top portion of the drum 29 under the effect of springs 33*a* to 33*e* (FIGS. 1, 4, and 6). These springs may be hairpin shaped, for example, with a plurality of turns disposed vertically in the housings for the pivoting teeth (FIGS. 4 and 6).

The rope wound on the drive zone 36 of the drum leaves this portion to enter the head by passing over a conventional rope-passing guide 38 which may be fixed or which may rotate about a guide supporting pin 39. The guide 38 is fixed on an appropriate projecting portion 41 of the fixed casing 40 of the head (FIGS. 1 and 2).

Figure 2:
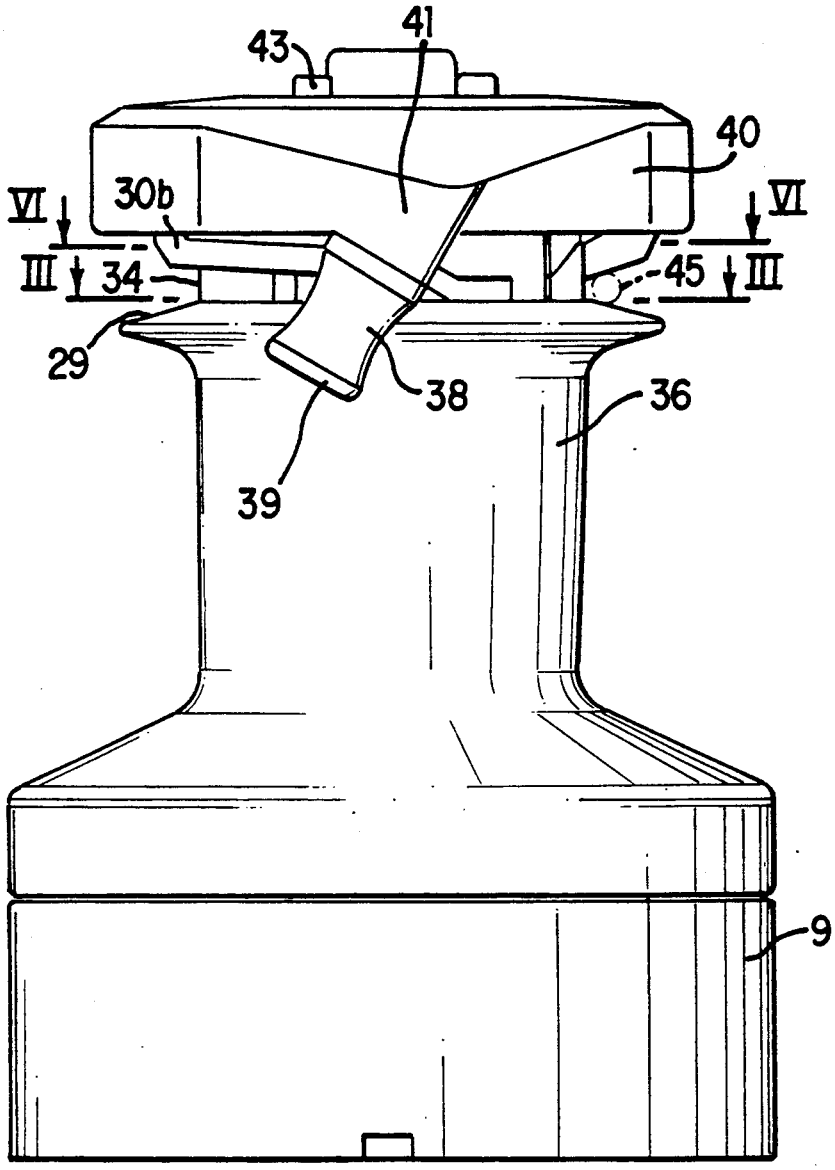
FIG. 2 is an elevation view as seen along arrow F of FIG. 1.

During rotary motion of the head, each tooth in turn climbs over the rope 45 and pitches it against the top portion 29 of the drum, as shown in FIG. 2.

By virtue of the tangential direction of the teeth whose pressure-applying edges 37 are tangential to a circle of diameter which is slightly smaller than that of the drum 1, the rope is caused to rotate and is pressed against the cylindrical portion 34 of the block 31 (FIG. 3).

By virtue of being pivoted about a horizontal pin 35, the available stroke of the pressure applying edges 37 of each tooth 30*a* to 30*e* is large, thereby enabling the teeth to pinch a wide variety of rope diameters automatically and without manual adjustment.

Unlike conventional systems in which a continuous circular jaw presses as a whole against the rope by means of a spring or position-adjusting system, interferring friction and rope wear is limited in this case by pinching the rope only along an appropriate direction and surface, thereby encouraging correct positioning of the rope on the cylindrical portion 34.

A conventional type of ejector 42 at the same level as the teeth 30 prevents the rope from continuing to rotate in the head after it has gone through a large enough angle of rotation. The rope is then ejected from the head (FIGS. 1, 2, and 6).

Figure 7:
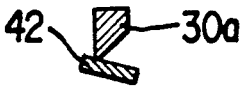
FIG. 7 is a section through a pivoting tooth and the ejector taken on line VII—VII of FIG. 6, and showing a cable ejector also acting as a separator cam with respect to the pivoting teeth.

This ejection may be further facilitated if the teeth are slightly raised by the ejector, thereby releasing the rope (FIG. 7).

The fixed casing 40 disposed around the self-tailing head protects the rotating portion of the head and supports the rope-passing guide 38 and the ejector 42. The ejector may be fixed to the guide-supporting pin 39.

The casing 40 is fixed to the base 2 of the winch by a conventional connection system such as screws 43 (FIGS. 1 and 2).

The top portion of the drive shaft 14 bears against a small bearing 55 which may be constituted by a small plastic tube.

The length of the drive shaft 14 depends on the size of the winch, but in all cases, a modular transmission assembly of standard size may have its shaft 21 connected to the end of the drive shaft.

I claim:

1. A self-tailing winch with pivoting teeth comprising a fixed support constituting a base, a drum mounted to rotate about the fixed support, a vertical shaft for driving the drum in rotation and connected thereto via a transmission including a stepdown gear train, and automatic clamping means for clamping cable or rope wound around the winch, which clamping means are mounted at the top of the drum in order to form a self-tailing head for the rope, wherein the automatic cable or rope clamping means comprise a plurality of pivoting teeth distributed at the periphery of the bottom portion of a block superimposed on the top portion of the drum and constrained to rotate therewith, the top portion of the drum being provided with a groove accommodating the bottom portion of said block, said pivoting teeth being pivoted about horizontal pins imprisoned in said groove formed in the top portion of the drum, the bottom portion of said block having an outer cylindrical portion whose diameter is substantially equal to the diameter of a drive zone of the drum, said pivoting teeth being guided laterally in slots provided in said block, and springs being mounted in said block in order to exert downward pressure individually on each of the pivoting teeth which themselves exert pressure individually on the rope in order to pinch the rope against the top end of the drum, wherein a fixed casing is mounted on the fixed support and surrounds the head of the winch in such a manner as to protect the rotary portions thereof, and wherein a guide for passing rope from the drum to the self-tailing head is fixed on said fixed casing.

2. A winch according to claim 1, further comprising an ejector mounted on said casing or on a support axis of said guide, and disposed above the end of the drum in such a manner as to prevent rope from continuing to rotate in the self-tailing head after said rope has rotated through a predetermined angle of rotation.

3. A winch according to claim 2, wherein the ejector is mounted at a level situated immediately beneath the pivoting teeth for pinching the rope.

4. A winch according to claim 2, wherein the ejector is mounted beneath the pivoting teeth at such a level as to constitute a cam which slightly raises each tooth as it passes over the ejector, thereby positively releasing the rope-pinching effect of the tooth.

5. A self-tailing winch with pivoting teeth comprising a fixed support constituting a base, a drum mounted to rotate about the fixed support, a vertical shaft for driving the drum in rotation and connected thereto via a transmission including a stepdown gear train, and automatic clamping means for clamping cable or rope wound around the winch, which clamping means are mounted at the top of the drum in order to form a self-tailing head for the rope, wherein the automatic cable or rope clamping means comprise a plurality of pivoting teeth distributed at the periphery of the bottom portion of a block superimposed on the top portion of the drum and constrained to rotate therewith, the top portion of the drum being provided with a groove accommodating the bottom portion of said block, said pivoting teeth being pivoted about horizontal pins imprisoned in said groove formed in the top portion of the drum, the bottom portion of said block having an outer cylindrical portion whose diameter is substantially equal to the diameter of a drive zone of the drum, said pivoting teeth being guided laterally in slots provided in said block, and springs being mounted in said block in order to exert downward pressure individually on each of the pivoting teeth which themselves exert pressure individually on the rope in order to pinch the rope against the top end of the drum, wherein the step down gear train transmission includes an epicyclic stepdown gear comprising a central gear fixed to the drive shaft, a bell-shaped gear comprising a toothed ring and an outlet gear, a set of planet gears cooperating with the ring and rotating about pins which are fixed to a planet carrier which is prevented from rotating in the reverse direction by a set of pawls, a toothed ring formed at the bottom of the drum, at least two diametrically opposite gear wheels on opposite sides of the shaft and cooperating with the outlet gear and with the toothed ring, and a set of pawls constraining the bell-shaped gear to rotate together with the shaft when the shaft is rotated in the opposite direction to the direction of drum rotation.

6. A winch according to claim 5, wherein the transmission assembly, apart from the diametrically opposite gear wheels and the toothed ring fixed to the drum constitutes a modular assembly which is independent of the size of the winch mounted on the drive shaft, said modular assembly being inserted into the support from the bottom, which bottom is closed by a removable plate.

7. A self-tailing winch with pivoting teeth comprising a fixed support constituting a base, a drum mounted to rotate about the fixed support, a vertical shaft for driving the drum in rotation and connected thereto via a transmission including a stepdown gear train, and automatic clamping means for clamping cable or rope wound around the winch, which clamping means are mounted at the top of the drum in order to form a self-tailing head for the rope, wherein the automatic cable or rope clamping means comprise a plurality of pivoting teeth distributed at the periphery of the bottom portion of a block superimposed on the top portion of the drum and constrained to rotate therewith, the top portion of the drum being provided with a groove accommodating the bottom portion of said block, said pivoting teeth being pivoted at their bottom rear ends about horizontal pins imprisoned in said groove formed in the top portion of the drum, the bottom portion of said block having an outer cylindrical portion whose diameter is substantially equal to the diameter of a drive zone of the drum, said pivoting teeth being guided laterally in slots provided in said block, and springs being mounted in said block in order to exert downward pressure individually on each of the pivoting teeth which themselves exert pressure individually on each of the pivoting teeth which themselves exert pressure individually on the rope in order to pinch the rope against the top end of the drum.

8. A self-tailing winch with pivoting teeth comprising a fixed support constituting a base, a drum mounted to rotate about the fixed support, a vertical shaft for driving the drum in rotation and connected thereto via a transmission including a stepdown gear train, and automatic clamping means for clamping cable or rope wound around the winch, which clamping means are mounted at the top of the drum in order to form a self-tailing head for the rope, wherein the automatic cable or rope clamping means comprise a plurality of pivoting teeth distributed at the periphery of the bottom portion of a block superimposed on the top portion of the drum and constrained to rotate therewith, the top portion of the drum being provided with a groove accommodating the bottom portion of said block, said pivoting teeth being pivoted about horizontal pins imprisoned in said groove formed in the top portion of the drum, the bottom portion of said block having an outer cylindrical portion whose diameter is substantially equal to the diameter of a drive zone of the drum, said pivoting teeth being guided laterally in slots provided in said block, and springs being mounted in said block in order to exert downward pressure individually on each of the pivoting teeth which themselves exert pressure individually on the rope in order to pinch the rope against the top of the drum, wherein a number of the pivoting teeth are lying in the range 4 to 8.

9. A self-tailing winch with pivoting teeth comprising a fixed support constituting a base, a drum mounted to rotate about the fixed support, a vertical shaft for driving the drum in rotation and connected thereto via a transmission including a stepdown gear train, and automatic clamping means for clamping cable or rope wound around the winch, which clamping means are mounted at the top of the drum in order to form a self-tailing head for the rope, wherein the automatic cable or rope clamping means comprise a plurality of pivoting teeth distributed at the periphery of the bottom portion of a block superimposed on the top portion of the drum and constrained to rotate therewith, said top portion of the drum being provided with a groove accommodating the bottom portion of said block, said pivoting teeth being pivoted about horizontal pins imprisoned in said groove formed in the top portion of the drum, the bottom portion of said block having an outer cylindrical portion whose diameter is substantially equal to the diameter of a drive zone of the drum, said pivoting teeth being guided laterally in slots provided in said block, and springs being mounted in said block in order to exert downward pressure individually on each of the pivoting teeth which themselves exert pressure individually on the rope in order to pinch the rope against the top end of the drum, wherein the ends of said pivoting teeth are caused to taper by respective sloping chamfers defining pressure-applying edges.

10. A self-tailing winch with pivoting teeth comprises a fixed support constituting a base, a drum mounted to rotate about the fixed support, a vertical shaft for driving the drum in rotation and connected thereto via a transmission including a stepdown gear train, and automatic clamping means for clamping cable or rope wound around the winch, which clamping means are mounted at the top of the drum in order to form a self-tailing head for the rope, wherein the automatic cable or rope clamping means comprise a plurality of pivoting teeth distributed at the periphery of the bottom portion of a block superimposed on the top of the drum and constrained to rotate therewith, said top portion of the drum being provided with a groove accommodating the bottom portion of said block, said pivoting teeth being pivoted about horizontal pins imprisoned in said groove formed in the top portion of the drum, the bottom portion of said block having an outer cylindrical portion whose diameter is substantially equal to the diameter of a drive zone of the drum, said pivoting teeth being guided laterally in slots provided in said block, and springs being mounted in said block in order to exert downward pressure individually on each of the pivoting teeth which themselves exert pressure individually on the rope in order to pinch the rope against the top end of the drum, wherein said pivoting teeth are disposed in the block in such a manner as to define a polygon, and have pressure-applying edges disposed tangentially to a circle whose diameter is slightly smaller than the diameter of the winding zone of the drum.

* * * * *